US006513909B1

(12) United States Patent
Elrod et al.

(10) Patent No.: US 6,513,909 B1
(45) Date of Patent: Feb. 4, 2003

(54) METHOD AND APPARATUS FOR MOVING INK DROPS USING AN ELECTRIC FIELD AND TRANSFUSE PRINTING SYSTEM USING THE SAME

(75) Inventors: Scott A. Elrod, La Honda, CA (US); Vittorio Castelli, Yorktown Heights, NY (US); Meng H. Lean, Briarcliff Manor, NY (US); Gregory J. Kovacs, Mississauga (CA); John S. Berkes, Webster, NY (US); Joy Roy, Freemont, CA (US); Donald L. Smith, Palo Alto, CA (US); Richard G. Stearns, Santa Cruz, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/280,717

(22) Filed: Mar. 30, 1999

Related U.S. Application Data

(63) Continuation-in-part of application No. 08/721,290, filed on Sep. 26, 1996, now abandoned.

(51) Int. Cl.[7] ..... B41J 2/06
(52) U.S. Cl. ..... 347/55
(58) Field of Search ..... 347/55, 151, 120, 347/141, 154, 103, 123, 111, 159, 177, 128, 131, 125, 158; 399/271, 290, 292, 293, 294, 295

(56) References Cited

U.S. PATENT DOCUMENTS

| | | | |
|---|---|---|---|
| 4,538,156 | A | 8/1985 | Durkee et al. |
| 4,697,195 | A | 9/1987 | Quate et al. |
| 4,734,705 | A | 3/1988 | Rezanka et al. |
| 4,752,783 | A | 6/1988 | Saito et al. |
| 4,860,036 | A | 8/1989 | Schmidlin |
| 5,099,256 | A | 3/1992 | Anderson |
| 5,245,358 | A | 9/1993 | Reeves et al. |
| 5,353,105 | A | 10/1994 | Gundlach et al. |
| 5,372,852 | A | 12/1994 | Titterington et al. |
| 5,389,958 | A | 2/1995 | Bui et al. |
| 5,471,233 | A | 11/1995 | Okamoto et al. |
| 5,477,249 | A | 12/1995 | Hotomi |
| 5,493,373 | A | 2/1996 | Gundlach et al. |
| 5,502,476 | A | 3/1996 | Neal et al. |
| 5,520,715 | A | 5/1996 | Oeftering |
| 5,614,933 | A | 3/1997 | Hindman et al. |
| 5,646,659 | A | 7/1997 | Moriyama et al. |

FOREIGN PATENT DOCUMENTS

| | | |
|---|---|---|
| EP | 0 437 062 A2 | 7/1991 |
| JP | 60-46257 | 3/1985 |
| JP | 62-199450 | 9/1987 |
| JP | 62-225353 | 10/1987 |
| JP | 2-184450 | 7/1990 |
| JP | 3-227248 | 10/1991 |
| JP | 4-294149 | 10/1992 |
| WO | WO 93/07000 | 4/1993 |

*Primary Examiner*—Raquel Yvette Gordon
*Assistant Examiner*—C Dickens
(74) *Attorney, Agent, or Firm*—Oliff & Berridge, PLC

(57) ABSTRACT

A method of forming and moving ink drops across a gap between a print head and a print medium, or intermediate print medium, in a marking device includes generating an electric field, forming the ink drops adjacent the print head and controlling the electric field. The electric field is generated to extend across the gap. The ink drops are formed in an area adjacent the print head. The electric field is controlled such that an electrical attraction force exerted on the formed ink drops by the electric field is the greatest force acting on the ink drops. The marking device may be incorporated into a transfuse printing system having an intermediate print medium made of one or more materials that allow for lateral dissipation of electrical charge from the incident ink drops.

22 Claims, 9 Drawing Sheets

METHOD AND APPARATUS FOR MOVING INK DROPS USING AN ELECTRIC FIELD AND TRANSFUSE PRINTING SYSTEM USING THE SAME

This is a Continuation Division Continuation-in-Part of application Ser. No. 08/721,290 filed Sep. 26, 1996. Now abandoned the entire disclosure of the prior application(s) is hereby incorporated by reference herein in its entirety.

BACKGROUND OF THE INVENTION

1. Field of Invention

This invention relates to ink jet printing, and more particularly, to using an electric field to charge and impart a force onto ink drops such that the ink drops are moved toward, and impact upon, a print medium. The invention is also directed to a transfuse printing system that utilizes ink jet printing.

2. Description of Related Art

Conventional ink drop printing systems use various methods to form and impact ink drops upon a print medium. Well-known devices for ink drop printing include thermal ink jet print heads, piezoelectric transducer-type ink jet print heads and bubble jet print heads. Each of these print heads produces approximately spherical ink drops having a 15 to 100 $\mu$m diameter. Acoustic ink jets can produce drops that are less than 15 $\mu$m in diameter. These smaller ink drops lead to increased resolution. Conventional print heads impart a velocity of approximately four meters per second on the ink drops in a direction toward the print medium.

Actuators in the print heads produce the ink drops. The actuators are controlled by a marking device controller. The marking device controller activates the actuators in conjunction with movement of the print medium relative to the print head. By controlling the activation of the actuator and the print medium movement, the print controller directs the ink drops to impact the print medium in a specific pattern, thus forming a desired image on the print medium.

Conventionally, the actuators also impart an impulsive force to propel the ink drops across a gap separating the print head and the print medium. A significant amount of energy is required to both form and propel the ink drops. Moreover, some types of actuators are very inefficient. For example, the efficiency of piezoelectric devices is approximately 30%. In acoustic ink jet printing, approximately 95% of the energy input to form and expel the ink drops is lost in the form of excess heat. Such excess heat is undesirable because it raises the operating temperature of the surrounding components, such as the print head. This leads to thermal stresses that decrease the long-term reliability of the device.

U.S. patent application Ser. No. 08/480,977 entitled "Electric-Field Manipulation of Ejected Ink Drops in Printing", which is commonly assigned, discloses providing an electric field to assist in directing ink drops toward the print medium in a desired manner, e.g., by selectively deflecting the ink drops slightly to enhance the resolution of the image produced by a given print head configuration. The ink jet actuators form and impart an initial velocity on the ink drops. The charged ink drops are then steered by electrodes such that the drops alternately impact upon the print medium at positions slightly offset from positions directly opposite the apertures of the print head.

Although this method increases the resolution of the image formed on the print medium, it does not address the problem of controlling the operating temperature of the print head. As a result, the high print head operating temperature shortens the usable life of the device.

Further, this method does not address the problem of satellite drops. Satellite drops are formed due to imperfections in the formation of primary ink drops. Satellite drops are much smaller than primary drops, and thus tend to be more influenced by environmental conditions, e.g., air currents in the gap. In conventional devices, the satellite drops decelerate rapidly due to higher air drag. At some point, the satellite drops return and impact on the print head. Other drops that cross the gap produce undesirable printing artifacts due to the result of air currents that reduce the print quality. This result is undesirable because the accumulation of satellite drops on the print head can decrease its performance over time.

Additionally, printing systems are known in which phase-change ink jet images are simultaneously transferred and fused to paper. These printing systems use metal intermediates that have a coating of a sacrificial liquid layer to insure release of the phase-change ink images formed thereon. In these systems, ink is ejected onto the metal intermediate to form ink images which are then transferred from the metal intermediate to paper. The image quality derived from a transfuse process is typically superior to direct marking on paper. However, with conventional ink jet, this quality can be compromised by the fact that drops do not land at the exact desired position on the intermediate, and the fact that the primary drop and any satellite drops do not travel at the same velocity. It is a further disadvantage of transfuse systems that they require significant heating of the paper, and hence require significant energy consumption. At higher print speeds, the combined energy requirements for the print head, ink reservoir and delivery system, and transfuse subsystems, can exceed the typical AC outlet capacity in an office environment. Such printing systems are described, for example, in U.S. Pat. Nos. 5,389,958; 5,372,852; 5,502,476; and 5,614,933.

SUMMARY OF THE INVENTION

It would be advantageous to.provide a method and a device for performing ink jet printing at a decreased operating temperature as a result of a lower required energy input.

It would also be advantageous to configure a marking device such that primary ink drops and satellite ink drops impact the print medium at the same time.

It would also be advantageous to control ink drop size such that ink drops having diameters of less than 15 $\mu$m are formed.

It would also be advantageous to facilitate biasing of the drops by induction.

These and other advantages are achieved by the method and apparatus of the present invention. The method includes the steps of generating an electric field across a gap between a print head and a print medium in a marking device, forming the ink drops adjacent the print head and controlling the electric field. The electric field is controlled such that an electrical attraction force exerted on the formed ink drops by the electric field is a greatest force acting on the ink drops.

The generating step can include biasing the print support medium with a voltage source. Further, the generating step can include charging the print head, e.g., setting the print head to ground.

The ink drops can be formed by exerting an ink drop forming force slightly greater than a threshold surface tension force that acts in a direction opposite the drop forming force.

The electric field can be controlled to maintain a field strength of approximately 1.0 V/$\mu$m. The electric field can also be controlled such that a travel time from the print head to the print medium is approximately the same for the primary and satellite ink drops that are smaller than the primary ink drops. The ink drops can be formed to have a radius of at least approximately 1 $\mu$m and not greater than 15 $\mu$m.

Forming the ink drops can include producing a plume of ink extending in a direction from the print head toward the print medium and separating an end portion of the plume to form the ink drops.

The electric field can be generated by a voltage source. The drops can be formed by an acoustic ink jet-type actuator. The gap between the print head and the print medium is preferably approximately 1 millimeter.

The apparatus of the present invention includes an ink jet marking device having a print head for forming an image on a print medium. The print head is separated from the print medium by a gap. The marking device includes a generating device that generates an electric field across the gap, a drop forming device that forms drops of ink adjacent the print head and a controller coupled to the drop forming device for controlling the electric field such that an electrical attraction force exerted on the formed ink drops is greater than other forces acting on the ink drops. The drop forming device is coupled to the generating device.

The ink jet marking device can also include a print medium support positioned on a side of the print medium opposite the print head. The print medium support is coupled to the generating device such that the generating device produces a voltage on the print medium support. Preferably, the generating device is a voltage source.

The drop forming device preferably forms drops of ink by exerting a drop forming force slightly greater than a threshold surface tension force acting in an opposite direction. Preferably, the drop forming device includes an acoustic ink jet-type actuator.

The apparatus of the present invention includes an ink jet marking device having a print head for forming an image on a print medium. The print head is separated from the print medium by a gap. Preferably, the marking device includes a generating device that generates an electrical field across the gap, a drop forming device that forms drops of ink adjacent the print head and a controller coupled to the generating device and the drop forming device for controlling the electric field such that an electrical attraction force exerted on the formed ink drops is greater than other forces acting on the ink drops.

The ink jet marking device can also include a print medium support positioned on the side of the print medium opposite the print head. The print medium support is coupled to the generating device such that the generating device produces a voltage on the print medium support. Preferably, the generating means is a voltage source.

The drop forming means preferably forms drops of ink by exerting a drop forming force slightly greater than a threshold surface tension force acting in an opposite direction. Preferably, the drop forming device includes an acoustic ink jet-type actuator.

This invention also provides a transfuse printing system in which the ink jet marking device is used to create an ink image on an intermediate medium which is subsequently transferred and fused to a final print medium. The transfuse printing system includes a belt as the intermediate medium and grounded rollers that serve to limit an area of high voltage to an area under the ink jet marking device.

The belt may be constructed of one or more materials that facilitate dissipation of electrical charge from the incident ink drops through the thickness of the belt and lateral voltage dissipation to the grounded rollers without excessive current to the grounded rollers. The dissipation of electrical charge through the thickness of the belt eliminates the negative effects of charge build up and image blooming. These materials may include materials having an intermediate conductivity such that the belt has a controlled conductivity that allows electrical charge to be dissipated through the thickness of the belt and voltage to be laterally dissipated to the grounded rollers.

Additionally, the ink jet marking device allows a thin layer of ink to be ejected onto the belt and thus, thermal build-up is reduced due to the reduction in the ink layer thickness.

BRIEF DESCRIPTION OF THE DRAWINGS

A complete understanding of this invention may be obtained by reference to the accompanying drawings, when considered in conjunction with the subsequent detailed description thereof, in which.

DETAILED DESCRIPTION OF PREFERRED EMBODIMENTS

Figure 1:
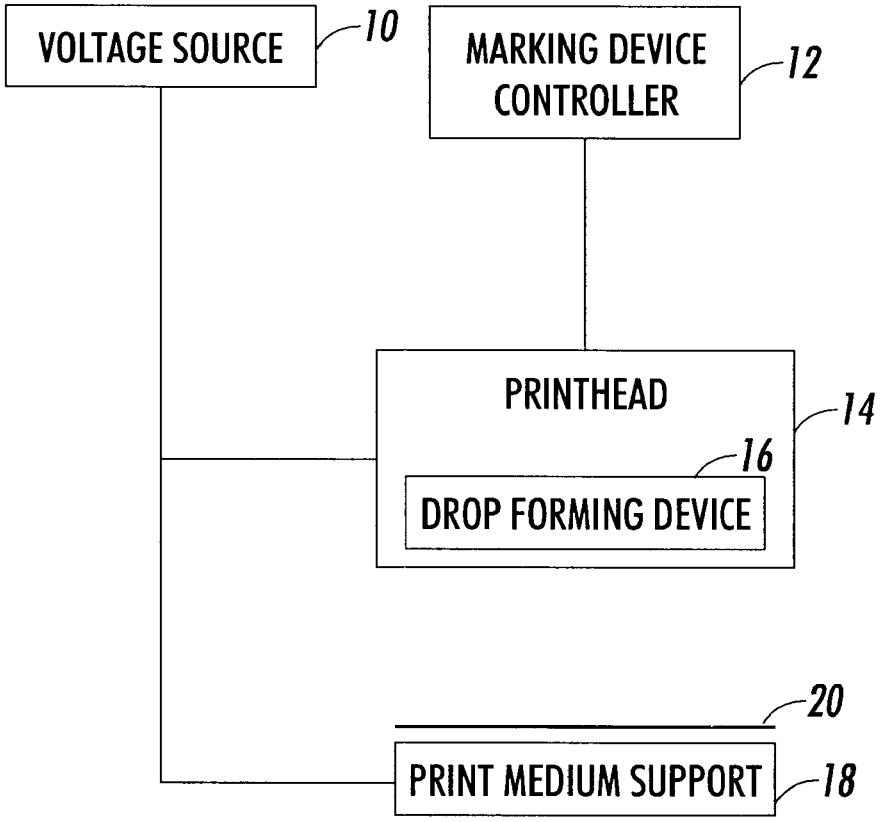
FIG. 1 is a block diagram showing a preferred embodiment of the invention.

In FIG. 1, a voltage source 10 is shown coupled to a print head and to a print medium support 18. A marking device controller 12 directly communicates with and is coupled to the print head 14. The marking device controller 14 controls a print medium movement mechanism (not shown) that moves a print medium 20 relative to the print head 14. The print medium 20 is preferably a sheet or roll of paper, but can also be transparencies or other materials.

In a preferred embodiment, the print head 14 is a page-width print head and the print medium 20 is moved relative to the print head 14. Alternatively, the print head 14 can be configured as a scanning print head to move relative to either a stationary or a movable print medium.

The print head 14 includes a drop forming device 16. In a preferred embodiment, the drop forming device 16 is an acoustic ink drop actuator, although other types of ink drop actuators, including thermal and piezoelectric transducer-type actuators, may be used.

Figure 2:
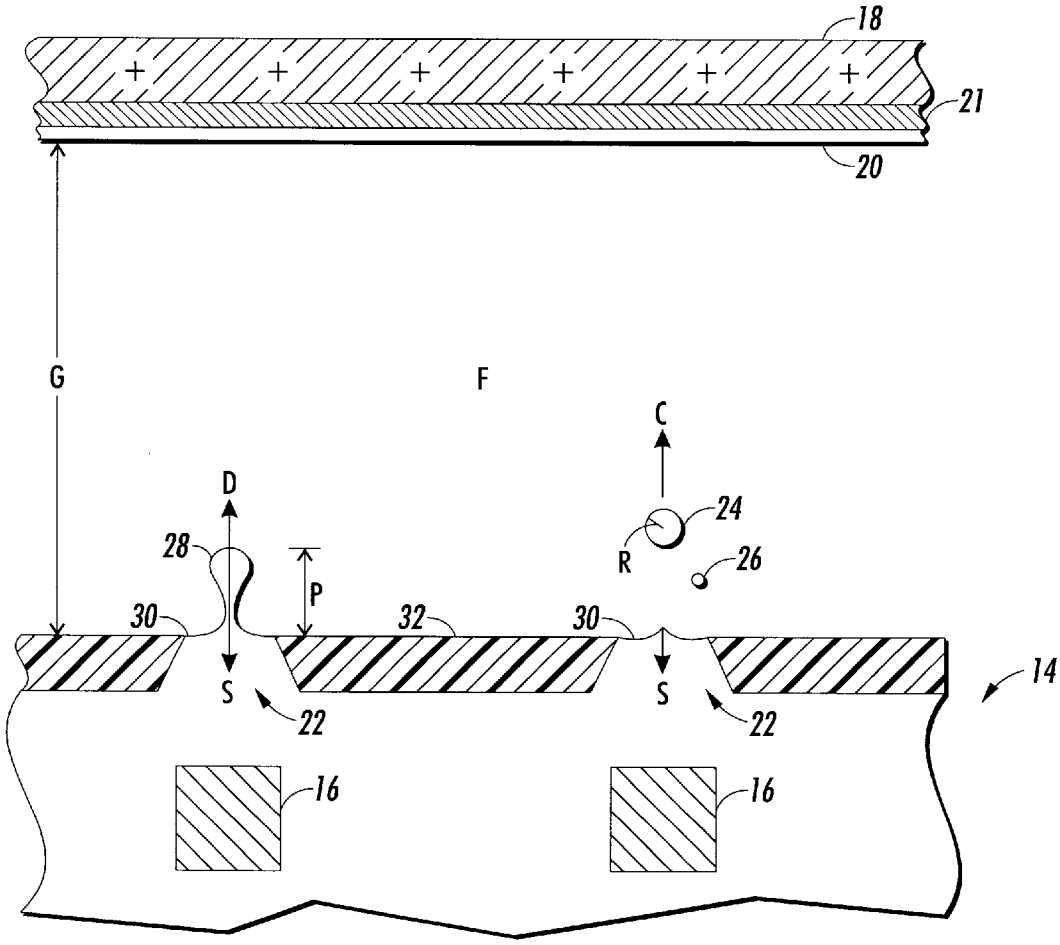
FIG. 2 is a top view of a marking device showing an ink drop being formed at the print head and subsequently drawn toward the print medium by a force created by an electrical field between the print head and the print medium.

As shown in FIG. 2, an electric field F is established between a print medium support 18 and a front surface 32 of the print head 14 by the voltage source 10. The print medium support 18 is made of a conductive material, usually metal. A dielectric coating 21 about 1 mil thick is coated onto the print medium support 18. The print medium 20 is positioned between the front surface 32 of the print head 14 and the print medium support 18 in contact with the dielectric coating 21. A gap G between the front surface 32 and the print medium 20 is approximately 1 mm.

The print head 14 includes a series of apertures 22, two of which are shown, through which ink exits the print head 14. The print head 14 also includes one or more drop forming devices 16 that impart energy into the surrounding ink to form drops at an ink surface 30 adjacent the front surface 32.

In a preferred embodiment, the drop forming device 16 is of the acoustic actuator-type. In an acoustic actuator-type drop forming device, a transducer is excited to produce an acoustic wave in the ink. The wave is focused through a Fresnel lens to a point just below the ink surface 30. The focused acoustic energy creates a pressure difference that causes an ink plume 28 to form, as shown in the left side of FIG. 2. The drop forming force D is a liquid jet which acts in a direction opposite the ink surface 30 and the drop forming device 16. The drop forming force D increases and eventually exceeds a threshold surface tension force S. The plume 28 breaks to form a primary drop 24, as shown in the right side of FIG. 2. The plume 28 extends outward from the ink surface 30 by a distance proportional to a radius of the resulting drop formed when the plume 28 breaks. Due to the biased field, the drop 24 is inductively charged with a polarity opposite the field.

In a conventional ink jet apparatus, the primary drop 24 is influenced by an additional expulsion force component that propels the primary ink drop 24 across the gap G to the print medium 20. In the device according to U.S. patent application Ser. No. 480,977, this expulsion force is further supplemented by a force due to an electric field established across the gap G. In the present invention, however, the drop forming force D is only slightly greater than the threshold surface tension force S that acts in the opposite direction. Therefore, the drop forming force D is only sufficient to form the primary drop 24.

A satellite drop 26 may also be formed due to imperfections in the formation of the primary drop 24. In conventional devices, satellite drops 26 tend to return toward and impact upon the front surface of the print head 32, which is undesirable. According to the present invention, satellite drops 26 are controlled to have the same flight time as primary ink drops.

The electric field F exerts a Coulomb force C on the primary and satellite ink drops. The ink drops of the present invention are formed without being forcibly expelled. The Coulomb force is the greatest force acting on the ink drops. Accordingly, the Coulomb force is greater than the other forces acting on the ink drops, which include the drag force due to friction between the ink drops and the air through which they travel.

Figure 3:
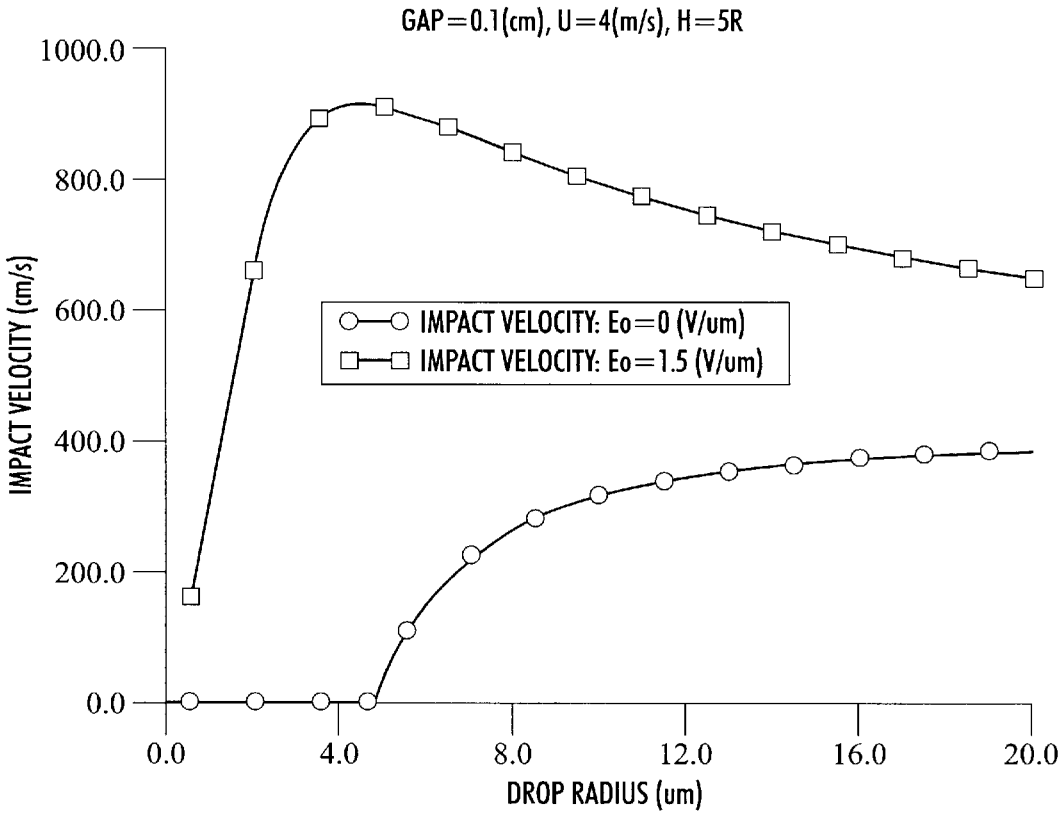
FIG. 3 is a graph showing the ink drop impact velocity versus the ink drop radius for two different field strengths.

FIG. 3 shows the effect of the drag force due to air. For drops that are ejected at 4 meters per second, which is within the range of conventional devices, drops having a radius of less than 4.6 $\mu$m are retarded by the drag force and fail to cross the gap, as indicated by the left-hand portion of the lower curve. The retarded ink drops return to the front surface 32, which contaminates the print head 14. As shown by the upper curve, a field strength of 1.5 V/$\mu$m ensures that ink drops of all sizes move under the Coulomb force C across the gap.

Within the electric field F, a finite charge is induced in the plume 28 proportional to the net voltage difference between the tip of the plume 28 and the front surface 32, the radius R of the ink drop and the voltage difference across the gap G (i.e., the field strength). By controlling the field strength, the amount of induced charge can be controlled. Correspondingly, by controlling the field strength, the dynamics of how quickly the ink drops travel across the gap (i.e., the "time of flight") can be controlled.

Figure 4:
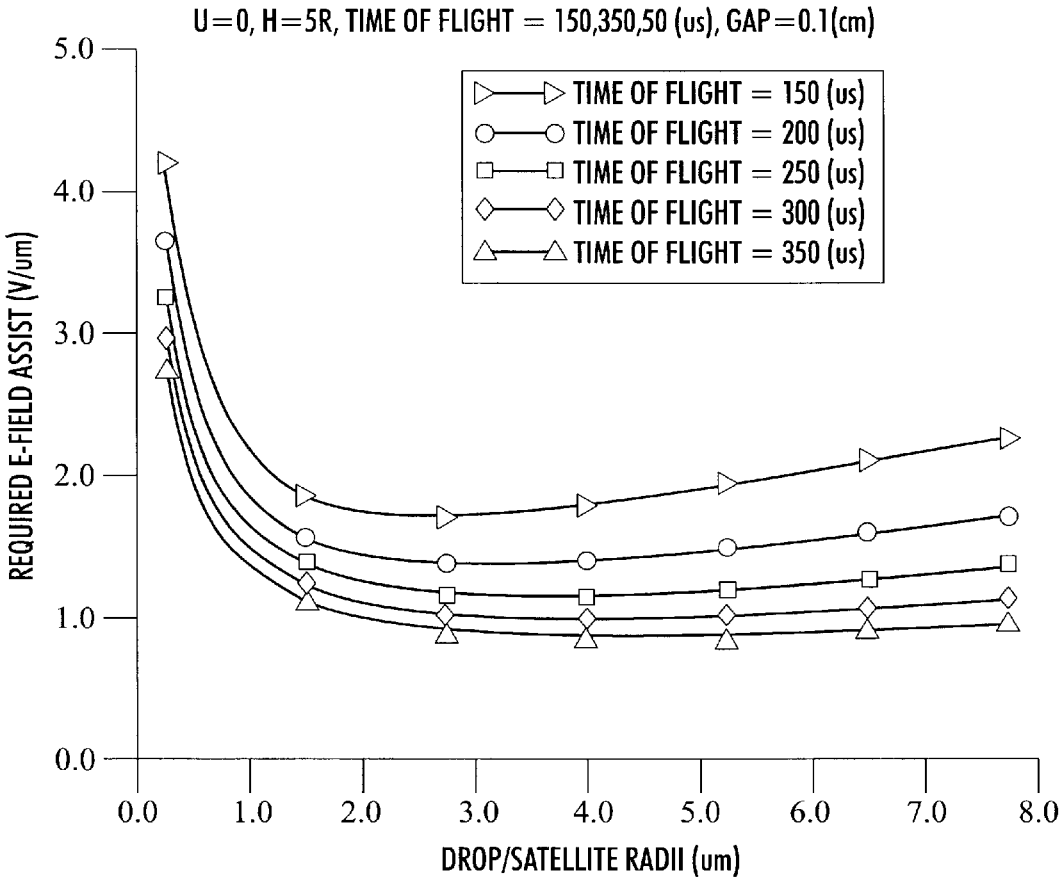
FIG. 4 is a graph showing the electric field strength versus the ink drop radius for various times of flight.

Therefore, the electric field F both charges and accelerates the ink drops. Referring to FIG. 4, a required field strength is determined by setting a simulation constraint such that drops having a range of radii traverse the gap within specified times of flight. Surprisingly, the times of flight for drops of different sizes are approximately the same for a field strength of 1.0 V/$\mu$m, as shown by the flat portion of the lowest curve. The times of flight for satellite drops in the lower range of radii and primary drops in the upper range of radii are approximately the same.

Figure 5:
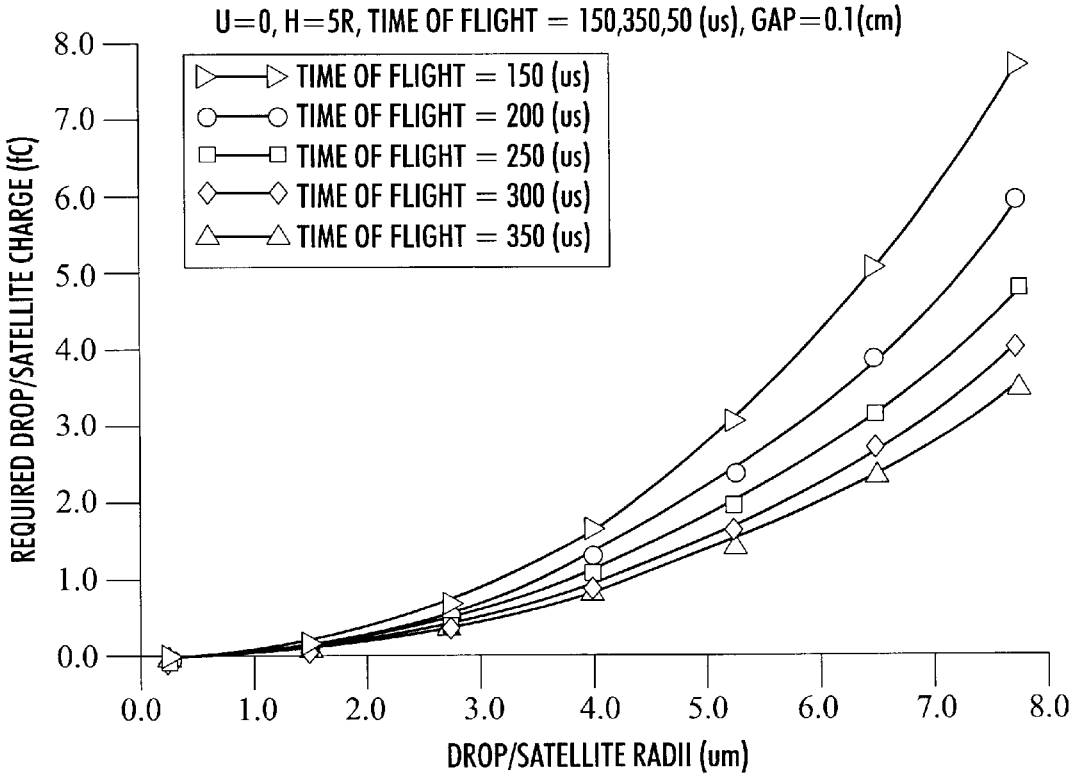
FIG. 5 is a graph showing the required ink drop charge versus the ink drop radius for various times of flight.

Referring to FIG. 5, the required drop charge to traverse the gap in the specified times of flight can be determined. In the range from approximately 1 to 8 $\mu$m as shown, the required level of charge can be obtained with aqueous inks. In particular, because this range of radii is in the transition region, neither the Coulomb force (which is inversely proportional to R) nor the drag force (which is inversely proportional to $R^2$) dominates.

Figure 6:
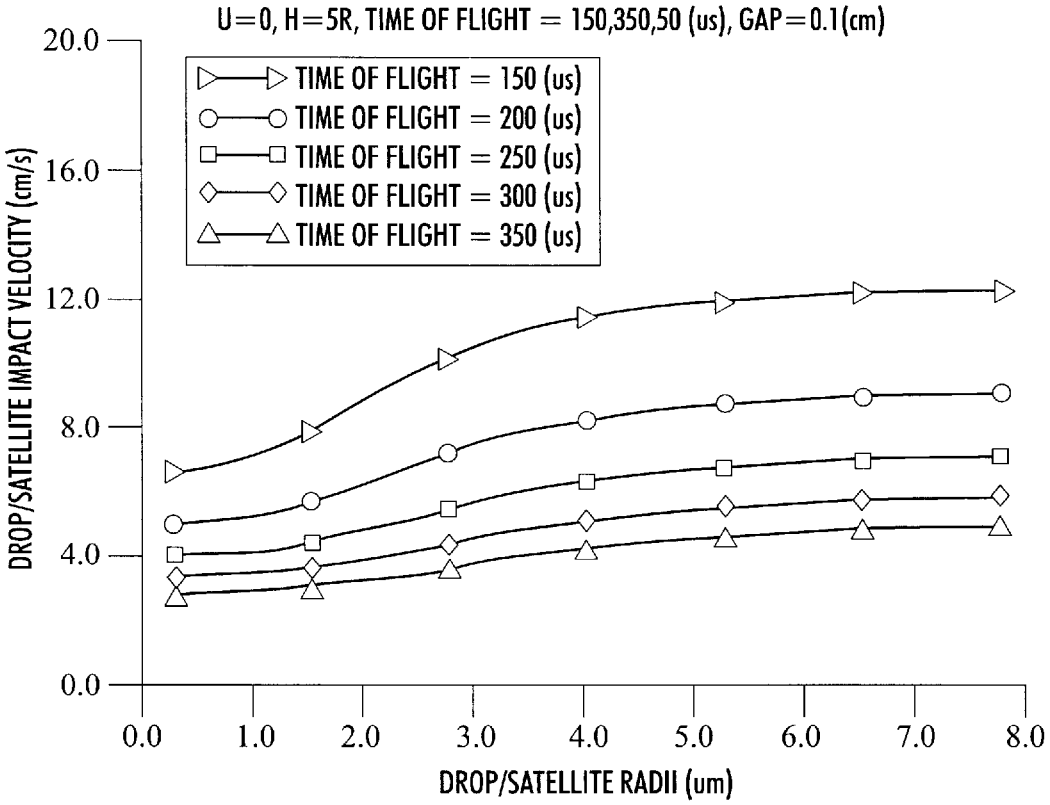
FIG. 6 is a graph showing the ink drop impact velocity versus the ink drop radius for various times of flight.

Referring to FIG. 6, the impact velocities corresponding to the range of electric field strengths can be shown. In particular, ink drops may accelerate from a velocity of zero to impact the print medium at a velocity of several meters per second by using a 1.0 V/$\mu$m, field.

Accordingly, by controlling the strength of the electric field, repeatable and controllable printer performance is possible. Test results show that an embodiment of the present invention requires 25% less energy to operate than a conventional device.

Figure 7:
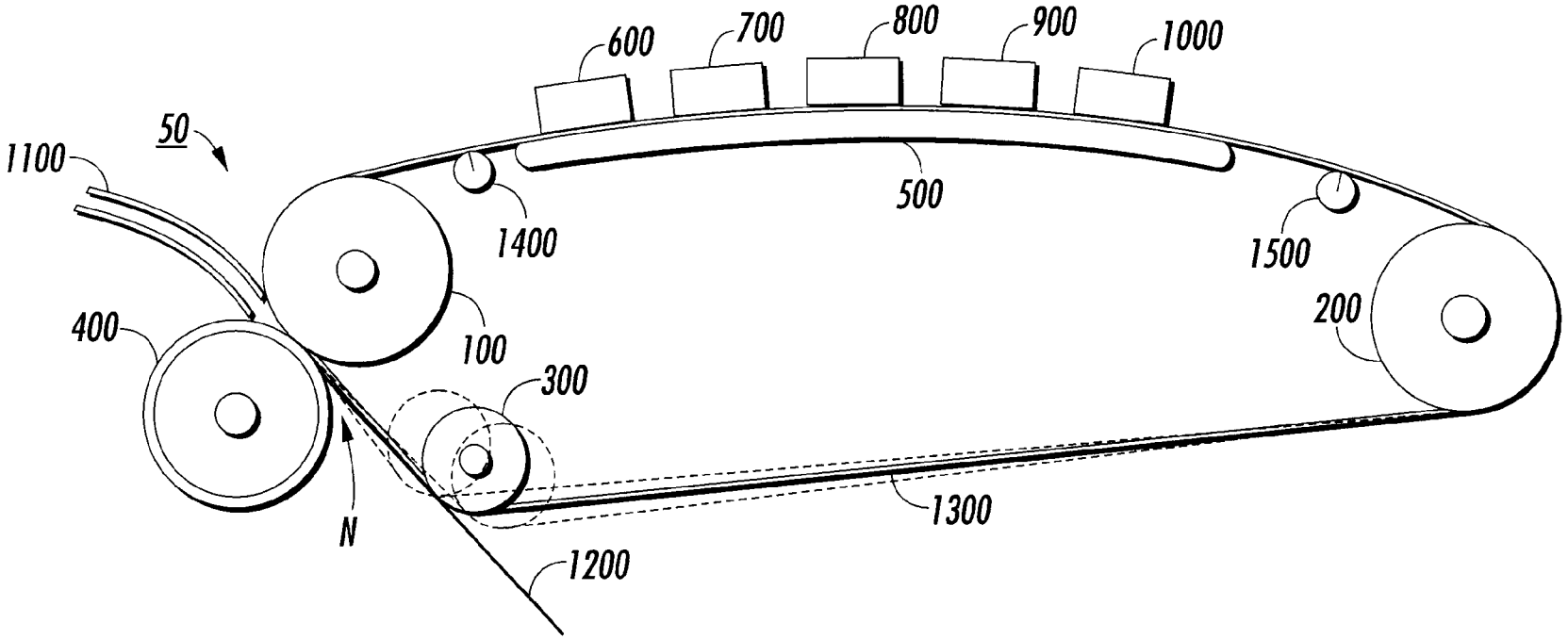
FIG. 7 is a schematic diagram of an exemplary transfuse printing system according to this invention.

The printing device shown in FIG. 1 may also be used in a transfuse printing system 50 such as that shown in FIG. 7. As shown in FIG. 7, the transfuse printing system 50 includes a drive roll 100, a steering roll 200, a tension roll 300, a pressure roll 400, a platen 500, grounded rollers 1400 and 1500 and a belt 1300. One or more print heads 600–1000 are situated on an opposite side of the belt 1300 from the platen 500. An inlet chute 1100 provides a pathway for a print medium 1200 to pass through a nip N formed between the drive roll 100 and the pressure roll 400.

The belt 1300 passes through the nip N, around the drive roll 100, passes over grounded roller 1400, the platen 500 and the grounded roller 1500, and around the steering roll 200. The belt 1300 serves as an intermediate medium for the ink drops ejected from the print heads 600–1000. Thus, the belt 1300 is driven by the drive roll 100 and carries the ink image to a point in the nip N where the ink image is transferred and fused to the print medium 1200.

The drive roll 100 and/or steering roll 200 may be temperature controlled to thermally condition the belt 1300. A heating source in the drive roll 100 and/or the steering roll 200 may be used to heat the belt 1300, and thus an ink image on the belt 1300, to aid in transferring and fusing the ink image to the print medium 1200, as described below. A cooling device may also be used to control the temperature of the belt 1300 so that thermal build-up is reduced.

The steering roll 200 serves as a support for the belt 1300 and may contain, for example, a cooling liquid or the like.

In this way, the steering roll 200 may serve as a heat sink to reduce the temperature of the belt 1300, and thus, any ink drops ejected onto the belt 1300 by the ink jet print heads 600–1000. In this way, thermal build up of the belt 1300 may be reduced.

The tension roll 300 may add tension to the belt 1300 and wrap the belt 1300 against the pressure roll 400. As shown in FIG. 7, the tension roll 300 may be positioned in a plurality of possible positions that wrap the belt 1300 against the pressure roll 400. The position of the tensioning roll 300 may be dependent on the specific architecture desired.

The pressure roll 400 applies pressure to the print medium 1200 and to the belt 1300 as they pass through the nip N between the pressure roll 400 and the drive roll 100. The print medium 1200 may have a rough surface. Thus, the pressure roll 400 serves to press the belt 1300, and an ink image on the belt 1300, against the rough surface of the print medium 1200. In this way, the pressure applied by the pressure roll 400 aids in transferring and fusing the ink image onto and into the rough surface of the print medium 1200.

The platen 500 may support the belt 1300 and may also act as a counter electrode for the print heads 600–1000. The platen 500 may be curved (as shown) or flat. The platen 500 may also be temperature controlled, by way of heating and/or cooling devices (not shown), to thereby thermally condition the belt 1300.

The grounded rollers 1400 and 1500 provide an electrical ground. In this way, a region of high voltage, due to an electric field generated between the print heads 600–1000 and the platen 500 or belt 1300, is limited to the area between the grounded rollers 1400 and 1500. Thus, the region of high voltage can be limited to only that region under the print heads 600–1000. By limiting the region of high voltage to only that area between the grounded rollers 1400 and 1500, the voltage on the belt 1300, and hence on the ink image on the belt 1300, is at a low level when the ink image passes through the nip N and over the drive and steering rollers 100 and 200.

The print heads 600–1000 may be any known or later developed print head that ejects ink drops onto the belt 1300. In one exemplary embodiment of the invention, the print heads 600–1000 are acoustic ink jet print heads such as that described with regard to FIGS. 1 and 2. The print heads 600–1000 preferably use a phase-change ink that is ejected onto the belt 1300. However, other types of inks may be used without departing from the spirit and scope of this invention.

In one exemplary embodiment of this invention, when an image is to be printed onto a print medium 1200, the image is formed on the belt 1300 using the ink jet print heads 600–1000. Each print head 600–1000 may be capable of ejecting ink drops of one or more different colors of ink. Thus, for example, the print head 600 may eject ink drops of colors cyan, magenta, yellow and/or black. Alternatively, the print head 600 may eject ink drops of a cyan color, the print head 700 may eject magenta ink drops, the print head 800 may eject yellow ink drops, the print head 900 may eject black ink drops, and so on. For ease of explanation, the exemplary embodiments of the transfuse system will be described with regard to a single print head 600 ejecting a single color of a phase-change ink.

The image is formed on the belt 1300 by ejecting ink drops, under control of the marking device controller 12 shown in FIG. 1, for example, in appropriate patterns to form the ink image. The ink image on the belt 1300 is placed by the drive roll 100 in contact with the print medium 1200 in the nip N between the pressure roll 400 and the drive roll 100. The print medium 1200 may be preheated by passing the print medium 1200 through a heated inlet chute 1100 to raise the temperature of the print medium 1200. Preheating the print medium 1200 may aid in fusing the ink image from the belt 1300 onto the print medium 1200.

The belt 1300 and the ink image may also be heated or cooled by an internal heat source or cooling device associated with the drive roll 100, steering roll 200 and/or platen 500. For example, if the belt is thermally conditioned by way of a heating source in the drive roll 100, steering roll 200 and/or platen 500, the combination of the heated print medium 1200, the heated ink image and the pressure from the pressure roll 400 causes the ink image on the belt 1300 to be transferred and fused to the print medium 1200.

Figure 8:
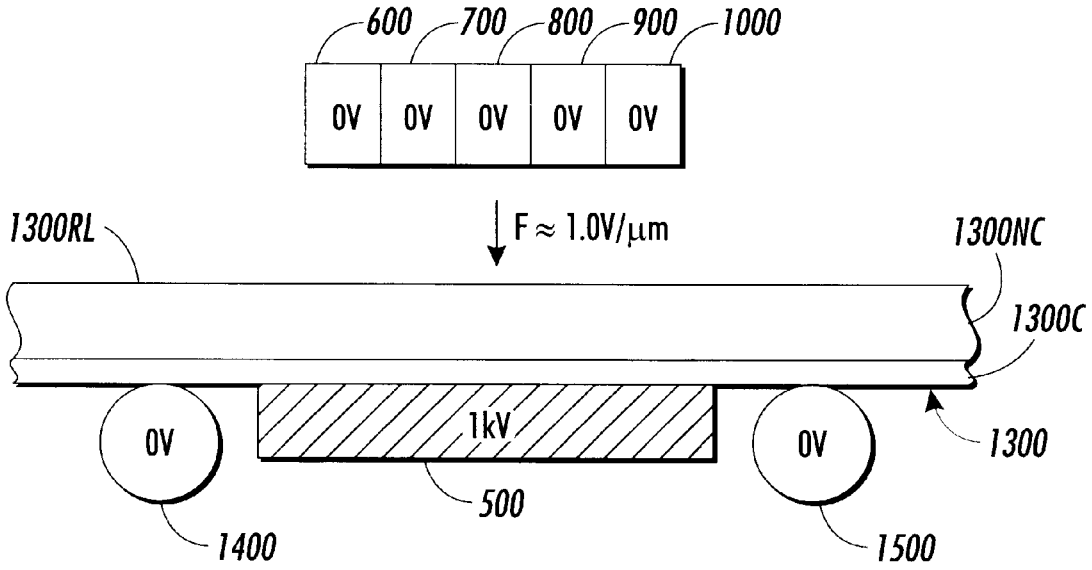
FIG. 8 is a more detailed exemplary schematic diagram of one section of the exemplary transfuse printing system of FIG. 7.

FIG. 8 is a schematic diagram of the portion of the transfuse printing system of FIG. 7 that lies between the grounded rollers 1400 and 1500. As shown in FIG. 8, the belt 1300 passes over the grounded rollers 1400 and 1500 and the platen 500. As described above, the grounded rollers 1400 and 1500 serve to localize a region of high voltage to the region between the grounded rollers 1400 and 1500.

The print heads 600–1000 include apertures through which ink exits. The print heads 600–1000 also include one or more drop forming devices, such as the drop forming device 16 shown in FIG. 1. The drop forming devices impart energy into surrounding ink to form drops at an ink surface adjacent the front surface of the print head. The drop forming device may include an acoustic actuator, a piezoelectric or thermal transducer, and the like.

In the transfuse printing system of this invention, thermal build-up on the intermediate print medium, such as the belt 1300, may occur due to the heat of the drops (i.e. the thermal load of the drops) ejected onto the intermediate print medium. This thermal build-up can occur when thick ink layers are deposited onto the intermediate print medium. Thermal build-up can lead to uneven solidification of subsequent drops, particularly as the intermediate print medium moves between consecutive print heads.

Thus, in one exemplary embodiment of the transfuse printing system of this invention, the print heads 600–1000 include acoustic ink jet print heads (AIP), such as the acoustic ink jet print heads described with regard to FIG. 2. Acoustic ink jet print heads form ink drops that are much smaller than those produced by conventional ink jet print heads. Therefore, a thinner layer of ink can be ejected onto the intermediate print medium. In this way, the thermal loading and thermal build-up can be reduced.

As discussed above with regard to FIG. 2, the ink drops may be formed by imparting an amount of energy to the ink that causes a drop forming force which has a magnitude that is just enough to overcome the surface tension of the ink, that is the drop forming force is only slightly greater than the threshold surface tension of the ink. Thus, the ink drops may be formed with substantially no velocity towards the print medium or intermediate print medium, such as the belt 1300. In this way, the ink drops may be formed without being forcibly expelled from the print head. However, in an alternative embodiment, additional energy may be applied to the ink to cause the ink drops to be formed with an initial velocity, depending on the particular applications of this invention.

In order to move the ink drops from the print head 600, for example, to the belt 1300, an electric field F is generated between the front surface of the print head 600 and the platen 500 or belt 1300 surface. In this case, the platen 500 or belt 1300 surface acts as a counter electrode. The electric field F may be generated by applying a voltage to the platen 500 to elevate the electrical potential of the platen 500 while maintaining the print head 600 at ground potential. If the belt 1300 is made from conductive material, contact between the belt 1300 and the platen 500 causes the belt 1300 to act as the counter electrode and an electric field F is generated between the print head 600 and the surface of the belt 1300.

The resulting electric field F both charges and accelerates the ink drops toward the belt 1300 from a velocity of substantially zero. Alternatively, if an initial velocity is imparted to the ink drops by the drop forming device 16, for example, the ink drops may be accelerated from that initial velocity. Because of the acceleration of the ink drops due to the electric field F, the ink drops may be ejected onto the belt 1300 reliably with greatly reduced position errors.

The amount of induced charge and the dynamics of how quickly the ink drops travel across a gap between the print head 600 and the belt 1300 may be controlled by controlling the field strength of the electric field F. In one exemplary embodiment, the field strength of the electric field F is controlled to maintain a field strength of 1.0 V/$\mu$m, to control a time of flight to traverse the gap between the print head and the print medium, or intermediate print medium, to be approximately the same time for drops of different sizes.

The belt 1300 may be made of one or more materials, and may be a composite of multiple materials, that provide the belt 1300 with an electrical conductivity that is sufficient to dissipate charge from the ink drops through the belt 1300 to the platen 500, but is low enough to keep the current flowing through the belt 1300 from the voltage source 10, for example, to the grounded rollers 1400 and 1500 at a sufficiently low level. For example, the belt 1300 may be constructed from materials having an intermediate conductivity, such as polyimide with controlled electrical conductivity, polyimide coated with a conductive rubber, and the like.

Similarly, the belt 1300 may be constructed of a layer of material 1300C having an intermediate conductivity and an outer compliant layer 1300NC that is non-conductive. With such a construction, the belt 1300 preferably has a thickness that is thin enough to minimize charging effects that could lead to blooming of the ink image. For example, the belt 1300 may be made of thin layer of a metallic material coated with a thin layer of nonconductive rubber, through which a voltage may be applied.

Alternatively, the belt 1300 may be made from a highly conductive material such as a metallic material or polyimide. The belt 1300 is this case has a high voltage everywhere and thus, the grounded rollers 1400 and 1500 are not necessary. However, the belt 1300 should be isolated from other components of the system to reduce the possibility stray charge and other undesirable effects.

In another embodiment, the belt 1300 may be made from a highly conductive material having an outer compliant layer. The outer compliant layer may be made of materials that are partially conductive, non-conductive, or highly conductive. For example, the belt 1300 may be made of a metallic material coated with a dielectric non-conductive rubber. The outer compliant layer allows the belt 1300 to press against the print medium 1200 and transfer the ink image to the rough surface of the print medium In yet another embodiment, the belt 1300 may be made from a layer of metallic material coated with a dielectric non-conductive rubber having a spray charge on the top surface. In this way, a compliant layer with an intermediate conductivity is utilized to aid in dissipating charge from the ink drops. The spray charge may be provided by any known or later developed means.

In one exemplary embodiment, the belt 1300 is made of an electrically conductive supporting substrate, such as polyimide, and an electrically conductive compliant layer, such as silicone rubber. In this exemplary embodiment, the polyimide and silicone rubber each have resistivities in the range of 1 to 100 megaohm-cm. The compliant layer facilitates the use of many types of print medium 1200 having various ranges of surface roughness.

In addition to the electrical properties of the belt materials, in one exemplary embodiment, the belt 1300 is made from one or more materials that do not require the use of a sacrificial liquid layer to release the ink image during transfer. For example, silicone rubber contains residual amounts of silicone oil that will slowly migrate toward the surface of the belt 1300 and provide a self-replenishing release layer 1300RL. Furthermore, silicone rubber may be doped to achieve the desired electrical conductivity properties. Other types of materials which eliminate the need for a sacrificial layer may be used without departing from the spirit and scope of this invention.

In the exemplary embodiments, the belt 1300 is made of one or more materials that allow for dissipation of charge from the ink drops through the belt 1300 to the platen 500. In the transfuse printing system, the ink drops ejected from the print heads 600–1000 are charged and accelerated by the electrical field F. Thus, when the ink drops impact the belt 1300, they have a charge associated with them. If the belt 1300 is not able to dissipate this charge, the charge begins to build up as additional ink drops are ejected onto the belt 1300. Thus, subsequent ink drops having a same charge as the previously ejected ink drops may be deflected by the built-up charge. This phenomenon is conventionally known as image blooming.

In the exemplary embodiments described above, because the belt 1300 is constructed of one or more partially conductive materials that allow the belt 1300 to dissipate the charge through the belt 1300 to the platen 500, charge build up is reduced. Thus, image blooming is greatly reduced and is appreciably zero.

Figure 9:
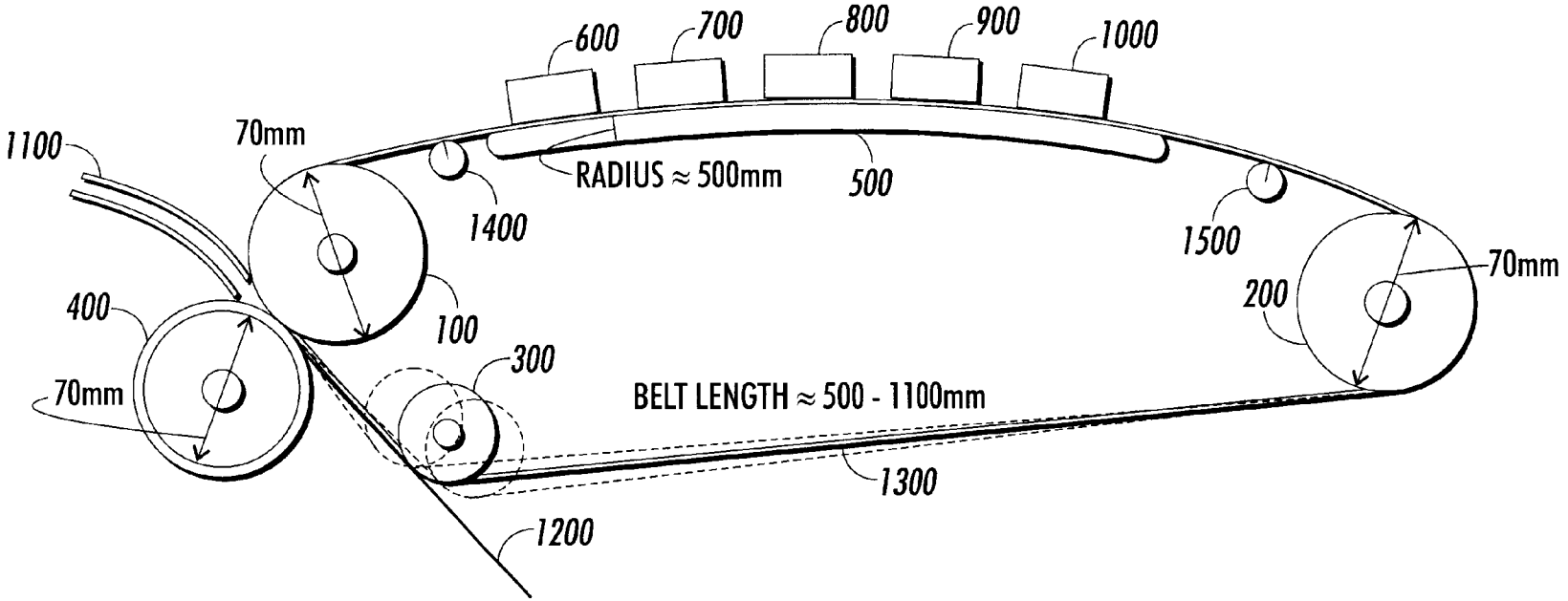
FIG. 9 is a schematic diagram of an exemplary transfuse printing system according to one exemplary embodiment of this invention.

As shown in FIG. 9, another exemplary embodiment of the transfuse printing system includes a drive roll 100, a steering roll 200 and a pressure roll 400, each having a diameter of approximately 70 mm, a tension roll 300 that wraps the belt 1300 against the pressure roll 400 for up to 10 degrees, and a curved platen 500 having a radius of curvature of approximately 500 mm and which is held at a potential of approximately 1 kV. The pressure roll 400 may be coated with a rubber material to increase the nip N width and aid in transferring the ink image from the belt 1300 to the print medium 1200 by providing a compliant surface that can form itself to the rough surface of the print medium 1200.

The inlet chute 1100 is heated to maintain the print medium 1200 at a desired temperature. The drive roll 100, steering roll 200 and platen 500 may include heating/cooling sources for increasing or decreasing the temperature of the belt 1300 to aid in transferring and fusing the ink image to the print medium 1200. A set of ground rollers 1400 and 1500 are maintained at 0 V.

The belt 1300 has a length of approximately 500 to 1100 mm and is formed by a substrate of polyimide having a thickness of approximately 75 microns. The polyimide has a controlled electrical resistivity of 1 to 100 megaohm-cm, and is coated with a 200 to 250 micron thick electrically conductive rubber layer, such as silicone or viton rubber. The silicone rubber may be loaded with carbon black, for example, such that the silicone rubber is electrically conductive. An additional thin layer of non-loaded silicone rubber may be added on top of the electrically conductive silicone rubber to provide the release properties described above.

The dimensions of the elements of the transfuse printing system shown in FIG. 9 are exemplary only and are not meant to limit the transfuse printing system in any way. As will be evident to one of ordinary skill in the art, depending on the particular use to which this invention is applied, the dimensions, orientations, and positions of the various elements of the transfuse printing system shown in FIG. 9 may be altered without departing from the spirit and scope of this invention.

As described above, the transfuse printing system may use the acoustic ink jet marking device shown in FIGS. 1 and 2. In this case, a reduction in the thermal build up on the belt 1300 is achieved. The reduction in the thermal build up provides for better quality of the resulting image on the print medium 1200. Furthermore, the belt 1300 is made of one or more materials that allow for dissipation of electric charge through the belt 1300 to the platen 500. Thus, charge build up is minimized. As a result, image blooming is reduced and is appreciably zero.

Although the invention has been described with reference to specific embodiments, the description of this specific embodiment is illustrative only and is not to be construed as limiting the scope of the invention. For example, the belt 1300 may be replaced by a drum having an outer coating comprised of the materials described above with reference to the belt 1300. In this case, since the drum is electrically conductive, a dielectric coating on the drum may be necessary. An electrically conductive layer of material may then be applied to the dielectric coating of the drum. Additional layers of material may be applied as described above to obtain desired electrical conductivity and release properties.

Thus, an electric field F may be generated between the drum and the print heads 600–1000. The grounded rollers 1400 and 1500 may be provided outside the drum to define a region of high voltage. Various other modifications and changes may occur to those skilled in the art without departing from the spirit and scope of the invention.

What is claimed is:

1. A transfuse printing system, comprising:

at least one print head that forms ink drops;

a platen; and an intermediate print medium positioned between the at least one print head and the platen, wherein an electric field is generated between the at least one print head and the platen and the ink drops are charged and accelerated by the electric field in the direction of the platen, and wherein the intermediate print medium has an electrical conductivity that is capable of dissipating a charge of the ink drops laterally through the intermediate print medium.

2. The transfuse printing system of claim 1, wherein the electrical conductivity of the intermediate print medium reduces charge build-up on the intermediate print medium.

3. The transfuse printing system of claim 1, wherein the intermediate print medium comprises a conductive supporting substrate and an electrically conductive compliant layer.

4. The transfuse printing system of claim 3, wherein the intermediate print medium further comprises a non-conductive release layer.

5. The transfuse printing system of claim 3, wherein the conductive supporting substrate is one of polyimide loaded for electrical conductivity and metal.

6. The transfuse printing system of claim 3, wherein the electrically conductive compliant layer is silicone rubber.

7. The transfuse printing system of claim 1, further comprising a pair of grounded rollers, wherein the grounded rollers define a region of high voltage between the grounded rollers.

8. The transfuse printing system of claim 1, further comprising drive means for driving the intermediate print medium through a transport path, wherein the drive means includes a heat source that heats the intermediate print medium.

9. The transfuse printing system of claim 1, further comprising pressure applying means for applying pressure to the intermediate print medium and a print substrate.

10. The transfuse printing system of claim 9, further comprises a heated inlet chute, wherein the print substrate is preheated by passing the print substrate through the heated inlet chute.

11. The transfuse printing system of claim 9, wherein the pressure applying means applies pressure to the intermediate print medium and a print substrate to transfer an ink image formed on the intermediate print medium to the print substrate.

12. The transfuse printing system of claim 1, wherein the at least one print head is an acoustic ink jet print head.

13. The transfuse printing system of claim 1, wherein the at least one print head forms ink drops by imparting an amount of energy into ink that causes a drop forming force which has a magnitude that is just enough to overcome a surface tension of the ink.

14. The transfuse printing system of claim 1, wherein the at least one print head forms ink drops without forcibly expelling the ink drops from the at least one print head.

15. The transfuse printing system of claim 1, wherein a field strength of the electric field is controlled to maintain a desired field strength.

16. The transfuse printing system of claim 15, wherein the desired field strength is 1.0 V/$\mu$m.

17. The transfuse printing system of claim 1, wherein the intermediate print medium comprises materials that facilitate transfer and fusing of an ink image to a print substrate without a sacrificial liquid layer.

18. The transfuse printing system of claim 17, wherein the materials include silicone rubber.

19. An intermediate print medium for use with a transfuse system, comprising:

a conductive supporting substrate; and an electrically conductive compliant layer, wherein the intermediate print medium has an electrical conductivity sufficient to dissipate a charge of ink ejected onto the intermediate print medium, laterally through the intermediate print medium.

20. The intermediate print medium of claim 19, wherein the conductive supporting substrate is one of polyimide loaded for electrical conductivity and metal.

21. The intermediate print medium of claim 19, wherein the electrically conductive compliant layer is silicone rubber.

22. The intermediate print medium of claim 19, further comprising a non-conductive release layer.

* * * * *